United States Patent [19]

Hyde

[11] 4,361,719

[45] Nov. 30, 1982

[54] EARTHING SYSTEMS

[76] Inventor: William Hyde, 52 Wilmay Ave., Auckland, New Zealand

[21] Appl. No.: 244,825

[22] Filed: Mar. 17, 1981

[51] Int. Cl.[3] ..... H01R 4/66

[52] U.S. Cl. ..... 174/6; 339/14 L; 339/28

[58] Field of Search ..... 174/2, 3, 5 SG, 6, 7; 339/14 L, 28, 29 R, 222, 275 RB

[56] References Cited

U.S. PATENT DOCUMENTS 1,634,689 7/1927 Schenk ..... 339/275 RB X 4,226,498 10/1980 Hauff ..... 339/29 R X

FOREIGN PATENT DOCUMENTS 465385 8/1951 Italy ..... 174/6

*Primary Examiner*—Laramie E. Askin

*Attorney, Agent, or Firm*—Holman & Stern

[57] ABSTRACT

An earthing system for domestic and commercial buildings comprises a lug formed from material compatible with reinforcing used in the building foundation, a flexible conductor and a fixing member. The lug and/or the fixing member are of different material than the conductor and are preferably welded to the conductor using an exothermic welding process.

5 Claims, 4 Drawing Figures

EARTHING SYSTEMS

BRIEF SUMMARY OF THE INVENTION

This invention relates to an earthing system.

It is an object of the present invention to provide an earthing system for use in building construction to provide an electrical connection to reinforcing elements of the construction.

Accordingly, in one aspect, the invention consists in an earthing system comprising a flexible electrical conductor; a lug welded to one end of said conductor; and a fixing member welded to the other end of said conductor wherein at least one of said lug and said fixing member are formed from a different material to said conductor.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DETAILED DESCRIPTION

Figure 1:
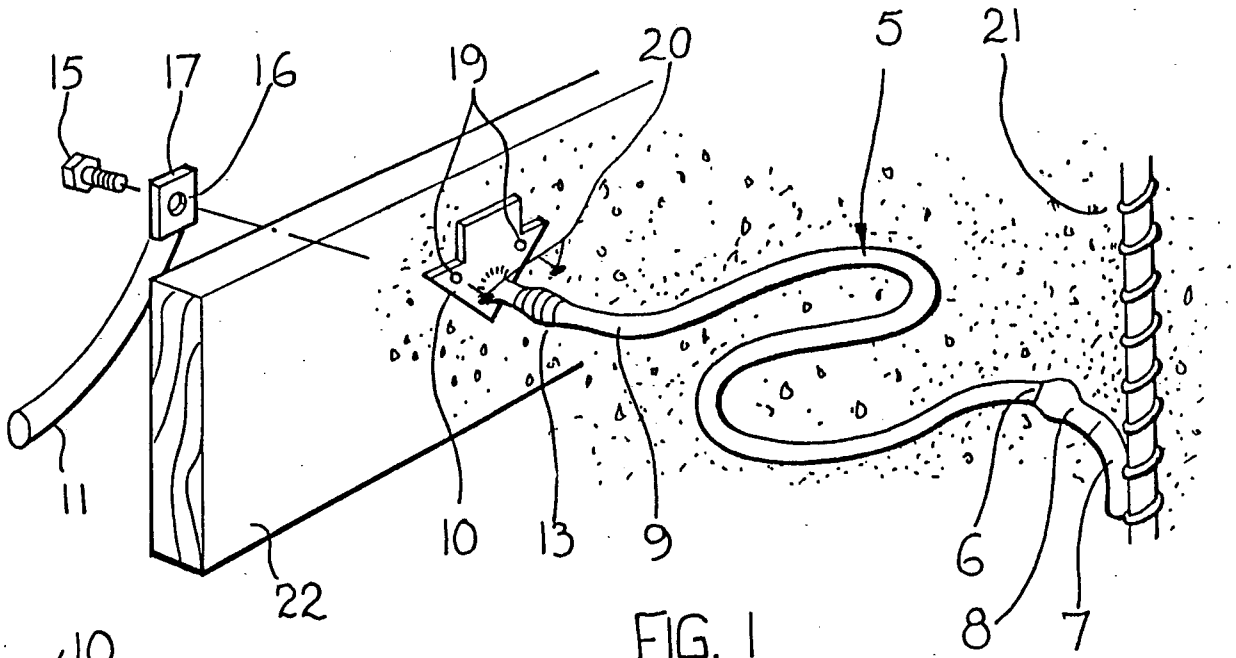
FIG. 1 is a diagrammatic view of a first form of earthing system according to the invention.
Figure 2:
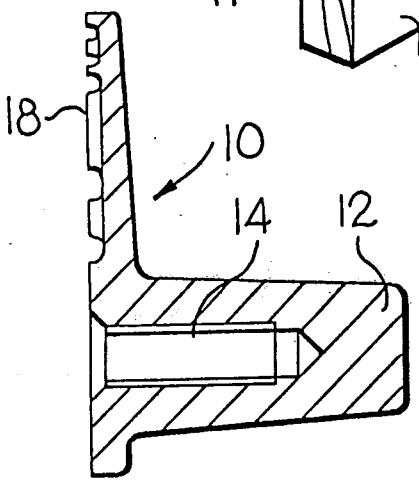
FIG. 2 is a cross section of a typical fixing member for use in the earthing system depicted in FIG. 1.

Referring firstly to FIGS. 1 and 2 of the drawings an earthing system is provided as follows.

A flexible conductor 5 is provided which is preferably an insulated copper conductor and is preferably of a standard length, for example 3 meters, although the length may, of course, vary according to the intended point of application of the earthing system.

Attached to one end 6 of the conductor 5 is a lug 7 preferably of steel and more preferably, mild steel, and the lug 7 is engaged with the conductor 5 by welding, preferably by exothermic fusion welding. While various forms of each welding exist, we have found that the CADWELD process of exothermic welding gives particularly good results in practice. Once the weld has been formed, an insulating sleeve 8 is then shrunk about the weld.

At the other end 9 of the conductor is provided a fixing member, preferably a fixing plate 10 which includes a first attachment means for the conductor 5 and a second attachment means for a further conductor 11.

The fixing plate 10 is preferably cast in bronze and the first attachment means, as shown, comprises a protrusion 12 with which the conductor 5 is engaged by means of a further weld, preferably an exothermic fusion weld, and once welded, the weld is preferably covered with a further shrink sleeve 13. The second attachment means, in the form shown, comprises a tapped bore 14 into which a threaded bolt 15 is engaged after passing through an aperture 16 in a fixing plate 17 engaged at one end of the further conductor 11.

The fixing plate 10 preferably has a substantially planar surface 18 and apertures 19 are provided through the plate, through which clouts or nails 20 may be driven in use to attach plate 10 to formwork 22.

In use, the lug 7, being of the same material as the reinforcing metal used in the structure, is engaged, preferably by conventional welding techniques, to a reinforcing bar 21 forming part of the reinforcing framework of the structure which is to be formed, at least in part, from cured cementitious material such as concrete. The fixing plate 10 is then positioned at the desired point in the structure so that it will be accessible from the outer surface of the structure when the structure has been formed. In particular, nails or clouts 20 are provided to mount the fixing plate 10 so that the surface 18 is positioned against the inner surface of the formwork 22 within which the cementitious material will be poured to form the structure.

The cementitious material is then poured and allowed to cure in substantially the known manner. As the cementitious material cures, it binds about the fixing plate 10 so that when the formwork is removed, the surface 18 lies substantially flush with the surface of the structure.

The earthing system is then completed by engaging the further conductor 11 between the fixing plate 10 and for example the switchboard of the building or an item of equipment requiring individual earthing.

Figure 3:
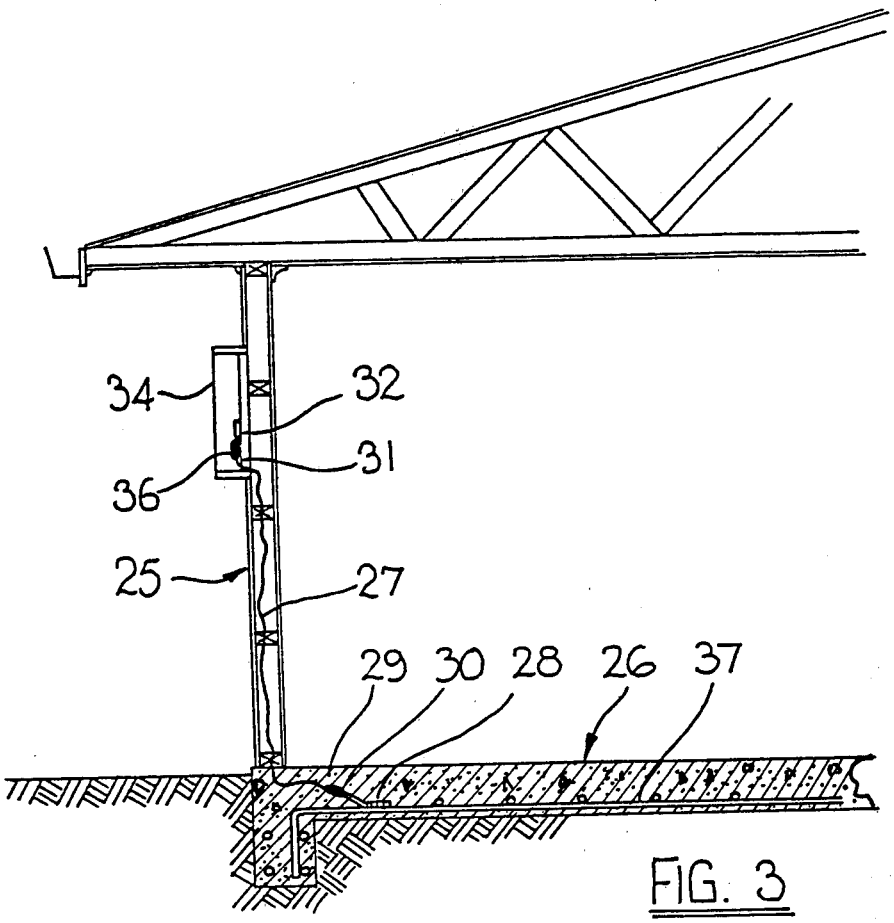
FIG. 3 is a diagrammatic sectional view of a domestic structure provided with an alternative form of earthing system according to the invention.
Figure 4:
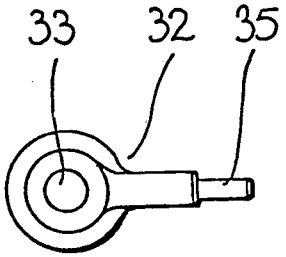
FIG. 4 shows a plan view of a typical fixing member for use in the system depicted in FIG. 3.

Referring now to FIGS. 3 and 4 an alternative form of earthing system is shown for smaller structures such as domestic dwellings which have brick, timber, metal or other sheathed, framed walls 25 mounted on a cured cementitious base 26.

In this embodiment a flexible conductor 27 is also provided, which again is preferably formed from insulated copper wire and again the conductor 27 is preferably provided with a mild steel lug 28 welded, preferably fusion welded using the CADWELD process, to one end 29 thereof. A shrink sleeve 30 is preferably provided around the weld so formed. At the other end 31 of the conductor 27 is preferably provided a fixing member in the form of a fitting 32 which, as shown in FIG. 4, comprises a bronze casting having an aperture 33 therein through which a suitable fixing bolt (not shown) may be engaged for attaching the fitting to framed wall 25. The fitting 32 further includes a pin or extension 35 whereby the fitting may be welded to the conductor 27, again preferably by the CADWELD process and thereafter fitted with a shrink sleeve 36.

As with the system above described, the lug 28 is of a compatible material to the reinforcing framework 37 provided in the base 26 and accordingly is simply fixed, preferably using conventional welding techniques, to the reinforcing framework 37 prior to the pouring of the cementitious material forming the base 26.

Once the lug 28 has been fixed to the reinforcing framework 37 and the base 26 formed, the wall frame is then erected, the conductor 27 being passed up through the framework so that the fitting 32 is positioned adjacent the sleeve box 34 and the wall cladding may then be placed in position.

Thus it will be appreciated that an earthing system is provided according to the invention which, at least in the preferred forms as described herein, have the following advantages:

(i) The connections between the basic conductor and the fixing lug and fitting members are all fusion welded and accordingly even though the lugs, conductors and fitting members may be formed of dissimilar materials, an effective electrical connection is provided between the fixing member and the lug which is not subject to the degree of deterioration commonly encountered using compression of clamping type joints as have been used commonly heretofore.

(ii) The lug, being formed of the same or a compatible material as the reinforcing bar in the structure, can be simply fixed to the reinforcing structure using conventional welding techniques. Accordingly, this fixing can be carried out effectively by unskilled or semi-skilled labour and the attachment of the fixing member to the formwork can also be carried out by low skilled labour.

What is claimed is:

1. An electrical earthing system which, in use, is fixed to electrically conducting parts of the reinforcing of a building structure, said system comprising:

(i) a lug formed from the same or substantially the same material as the electrically conducting parts of said reinforcing;

(ii) a flexible conductor welded at one end thereof to said lug; and (iii) a fixing member formed of a material of higher electrical conductivity than said lug welded to the other end of said flexible conductor, said fixing member having a substantially planar surface portion, a tapped aperture set into said fixing member through said substantially planar surface portion to facilitate attachment of a further conductor thereto, and at least one aperture passing entirely therethrough and through said planar surface portion, whereby said planar surface portion may be attached to the planar surface of a member used in constructing the building.

2. A system as claimed in claim 1 wherein said lug and fixing member are welded to said conductor by exothermic fusion welding techniques.

3. A system as claimed in claim 1 or claim 2 wherein said lug, said fixing member and said conductor are all formed from dissimilar materials.

4. A system as claimed in claim 1 wherein said fixing member has a substantially circular protrusion on the side thereof opposite to said planar surface and said other end of the conductor is attached to said protrusion.

5. A system as claimed in claim 4 wherein said circular protrusion is coaxial with said tapped aperture.

* * * * *